US007691447B2

(12) United States Patent
Chang

(10) Patent No.: US 7,691,447 B2
(45) Date of Patent: Apr. 6, 2010

(54) CONTAINER MADE OF A POROUS MATERIAL AND COATED WITH PRECIOUS METAL NANOPARTICLES AND METHOD THEREOF

(75) Inventor: Wen-Lie Chang, Taipei (TW)

(73) Assignee: Chun-Ying Kuo, Taipei (TW)

( * ) Notice: Subject to any disclaimer, the term of this patent is extended or adjusted under 35 U.S.C. 154(b) by 954 days.

(21) Appl. No.: 11/474,425

(22) Filed: Jun. 26, 2006

(65) Prior Publication Data

US 2007/0297931 A1 Dec. 27, 2007

(51) Int. Cl.
*B05D 3/02* (2006.01)

(52) U.S. Cl. ..... 427/376.6; 419/2; 428/34.4; 977/900

(58) Field of Classification Search ..... 427/376.6; 428/34.4; 419/2; 977/900
See application file for complete search history.

(56) References Cited

U.S. PATENT DOCUMENTS 5,543,186 A * 8/1996 Andersen et al. ..... 428/34.4
2004/0170822 A1* 9/2004 Rohrbaugh et al. ..... 428/323
2006/0068189 A1* 3/2006 Raybould et al. ..... 428/307.3

* cited by examiner

*Primary Examiner*—Shamim Ahmed
(74) *Attorney, Agent, or Firm*—Bacon & Thomas, PLLC

(57) ABSTRACT

A container made of a porous material and coated with precious metal nanoparticles is disclosed. The method of making it includes: adding precious metal nanoparticles and intermedium particles to a solution; maintaining the solution at a first temperature; heating a container body made of a porous material at a second temperature; and immersing the container body in the solution wherein the temperature difference between the first temperature and the second temperature causes the precious metal nanoparticles and intermedium particles to permeate into the pores of the container body. The resultant container has precious metal nanoparticles not only attached to its surface but also within its pores.

13 Claims, 2 Drawing Sheets

CONTAINER MADE OF A POROUS MATERIAL AND COATED WITH PRECIOUS METAL NANOPARTICLES AND METHOD THEREOF

FIELD OF THE INVENTION

The present invention relates to a container made of a porous material and a method making same, and more particularly to a method enabling precious metal nanoparticles and intermedium particles to permeate into the pores on the surface of the container, forming a nano-scale precious metal film on the container with enduring anti-bacteria, antiseptic and catalytic effects.

BACKGROUND OF THE INVENTION

Nanometer (nm) is a unit of length; one nanometer is equal to one billionth of a meter ($10^{-9}$ m), which is approximately the size of a DNA molecule or one ten-thousandth of the width of human hair. The term "nano-scale" refers to a size of approximately 1 nm to 100 nm, which falls between the size of a molecule and submicron-scale. A "nanoparticle", i.e., a nano-scale particle is so small that classic theories are no longer applicable, while quantum effect becomes non-negligible. Since nano-scale materials have a large surface-to-volume ratio, high density in accumulation, and high flexibility in structure formation, the physical and chemical properties of a nano-scale material are significantly different from the properties of the same material in macro-scales. For example, the color of gold nanoparticles are red, not gold. Such phenomenon shows that the optical properties vary when the size of a material is in nanometer scale. As another example, the texture of graphite is soft and thus it can be used for making pencil leads, but the strength of carbon nanotubes made of a carbon nano material is much stronger than the strength of stainless steel, and also providing a very good flexibility.

With the foregoing reasons, more and more studies have been spent on nanotechnology, resulting in developments in many areas from consumer's products to high-tech industries. Particularly, it is a trend to study how precious metal materials such as gold and silver may be applied to daily necessities by nanotechnology. For example, nano-scale gold is used to make clothes and catalytic materials; due to its capability of carrying oxygen, it promotes human blood circulations and metabolism and also activates cells. As another example, silver is non-toxic, and it has an anti-bacteria effect that can kill more than 600 types of germs (general antibiotics can kill only 6 types of germs). Furthermore, silver nanoparticles are even more active than macro-scale silver. Therefore, applying silver nanoparticles in anti-bacteria, deodorant and antiseptic applications may provide great effects.

More specifically, silver nano-scale particles and silver ions released from nano-scale silver have a significant anti-bacteria effect that they are capable of suppressing over 99% of the colon bacillus, *staphylococcus aureaus, salmonellosis*, and *pseudomonas aeruginosa*, etc., due to the biological effect of silver as follows. The active silver ions released from nano-scale silver can quickly absorb and combine with the sulfur-hydrogen radicals of the proteases in germs, such that the enzyme of the sulfur-hydrogen radicals becomes inactive and causes the death of germs. Silver nanoparticles carrying positive electric charges and microorganism cells carrying negative charges will attract each other so that the silver nanoparticles will puncture through the outer cell wall to change the internal properties and reduce the growing ability of the microorganism, so that the cells cannot continue their metabolism or reproduction until they die. It is noteworthy that after the death of the germs, silver ions will shift from the dead germs to live germs, and the same action will be repeated until all the germs are eliminated. Therefore, nano-scale silver as an anti-bacteria material has many advantages, including long active lifetime, non-toxic, that it does not result in drug resistance or allergic reaction, that it does not require any light for its activation, and that it is not affected by pH values. Nano-scale silver can also be used for suppressing the growth of moulds for antiseptic function.

In view of the foregoing facts, in recent years many manufacturers for containers made of a porous material (such as stone pots, stone kettles, ceramic pots and ceramic kettles) attempt to apply nano-scale precious metal material to the manufacture of such containers, so as to provide, for example, anti-bacteria, antiseptic, and deodorant effects, and catalyzing effects to improve food smell and taste. The conventional method to do so is to mix the precious metal nanoparticles with a diluted adhesive solution, and then immerse the container made of a porous material into the solution. Next, the container is removed from the solution and dried to produce a container coated with precious metal nanoparticles. However, in the container produced by such a conventional method, due to surface tension of the solution, the precious metal nanoparticles do not permeate into the pores densely distributed on the surface of the container but are only loosely attached onto the surface of the container. Thus, after the container is dried, there is only a thin film of precious metal nanoparticles formed on the surface of the container, which may easily be worn out or peeled off when, for example, washed for several times, and the anti-bacteria, antiseptic, deodorant and catalytic effects will be lost. Therefore, it is desired in this art to manufacture a container made of a porous material wherein precious metal nanoparticles permeate into the pores densely distributed on the surface of the container and sintered therewith, so as to form a robust precious metal nanoparticles film that is not easily worn out nor peeled off.

SUMMARY OF THE INVENTION

In view of the shortcomings of the conventional container that the anti-bacteria, antiseptic, deodorant and catalytic effects are lost easily because the thin film of precise metal nanoparticles is not tightly attached to the surface of the container, the inventor of the present invention has developed a container that is made of a porous material and coated with precious metal nanoparticles, and a method for making the container, which resolve the drawbacks encountered in the conventional method.

It is an objective of the present invention to provide a method for manufacturing a container made of a porous material and coated with precious metal nanoparticles, and the manufacturing method comprises the steps of: adding precious metal nanoparticles and intermedium particles to a solution; mixing the precious metal nanoparticles and intermedium particles evenly in the solution; maintaining the solution at a first temperature; putting a container body made of a porous material (such as a ceramic or stone material) into an oven and heating the container body at a second temperature larger than the first temperature, wherein the temperature difference between the first temperature and the second temperature is large enough for the solution, and hence the precious metal nanoparticles and intermedium nanoparticles in the solution, to permeate into the pores on the surface of the porous container body when the container body is immersed in the solution.

Another objective of the present invention is to provide a method for making a container made of a porous material and coated with a precious metal nanoparticles, wherein in addition to the foregoing method steps, the material properties of the intermedium particles are similar to those of the porous material, such that the two can be sintered together at a high temperature. After the precious metal nanoparticles and the intermedium particles permeate into the pores on the surface of the container body, the container body is removed from the solution and placed into an oven for heating the container body at a third temperature, whereby the intermedium particles permeating into the surface of the container body are melted and combine with the precious metal nanoparticles, and both of the precious metal and the intermedium are sintered on the surface and in the pores of the container body.

Another objective of the present invention is to provide a container, which comprises a container body made of a porous material and having a plurality of pores distributed on a surface of said container body; intermedium particles in said pores; and precious metal nanoparticles in said pores. The precious metal nanoparticles permeate into the pores, and by means of the intermedium particles which are sintered with the surface of the container body, the precious metal nanoparticles are also strongly combined with the porous material of the container body. The container thus provides enduring anti-bacteria, antiseptic and catalytic effects.

DETAILED DESCRIPTION OF THE PREFERRED EMBODIMENTS

Figure 1:
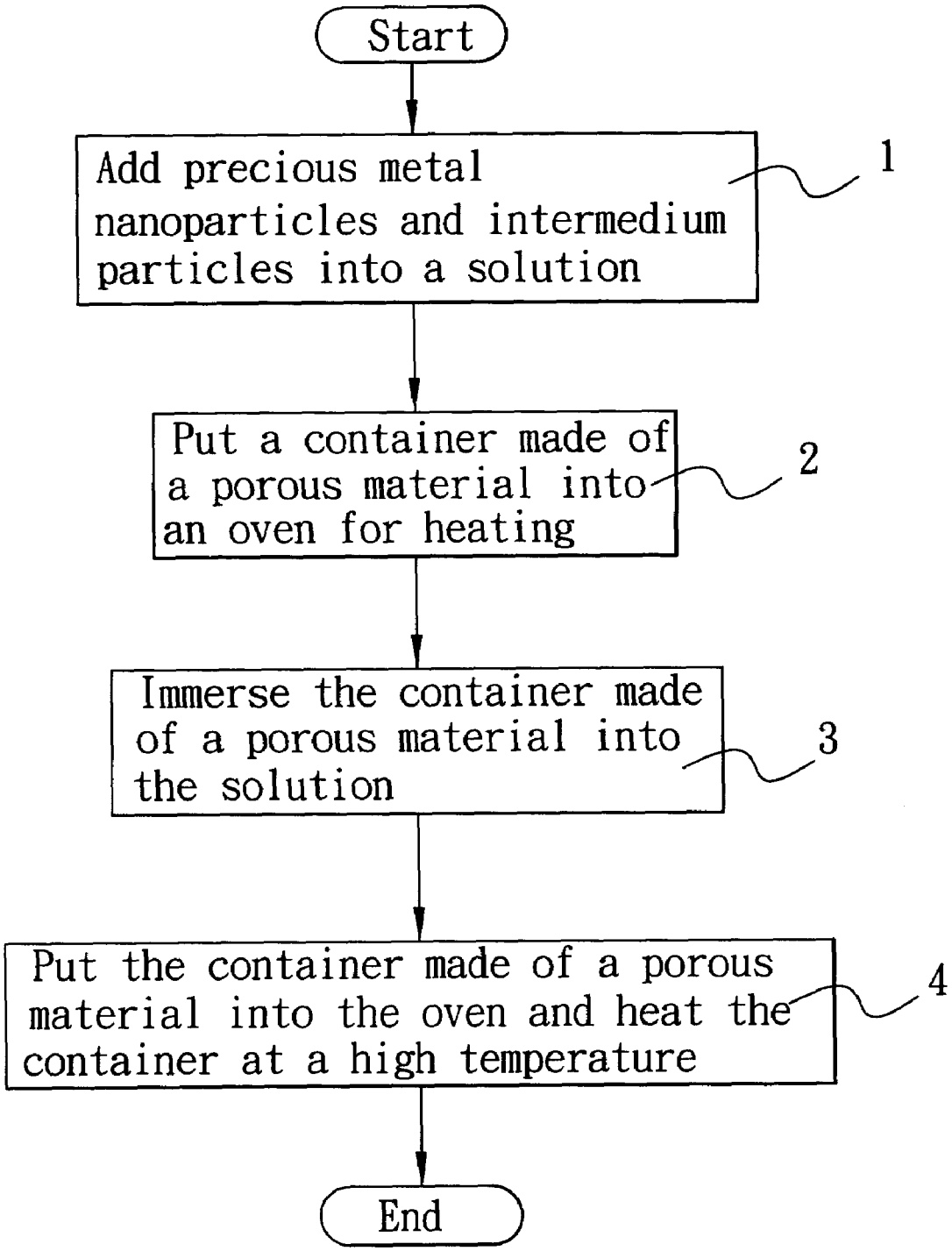
FIG. 1 is a flow chart of a manufacturing process of the present invention.

The present invention proposes a container made of a porous material and coated with precious metal nanoparticles, and a method of making the container. In accordance with the present invention, precious metal nanoparticles and intermedium particles (preferably nanoparticles) are added into a solution, and a temperature difference is provided so that the solution, with the precious metal nanoparticles and the intermedium particles in the solution, permeate in the pores on the surface of the container body made of a porous material. Next, a high temperature is provided to melt the intermedium particles which have permeated in the pores on the surface of the container body so that the intermedium particles combine with the precious metal nanoparticles and are sintered with the surface of the container body to form a nano-scale precious metal film. Referring to FIG. 1, the manufacturing method of the invention comprises the following steps.

(1) Add precious metal nanoparticles and intermedium particles into a solution and mix the two evenly in the solution. Thereafter, the solution is kept in a first temperature range. The material of the intermedium particles is selected from materials having material properties similar to those of the porous material making the container body.

(2) Put the container having its body made of a porous material (such as a ceramic or stone material) into an oven to heat the container at a second temperature, wherein the second temperature is higher than the first temperature.

(3) Immerse the container into the solution, so that the solution, and the precious metal nanoparticles and the intermedium particles in the solution, permeate into the pores densely distributed on the surface of the container due to the temperature difference between the first temperature and the second temperature.

(4) Remove the container from the solution, and put the container into an oven to heat the container at a third temperature so that the water content in the solution is thus evaporated. The intermedium particles permeating into the pores on the surface of the container are thus melted to combine with the precious metal nanoparticles, and the combined intermedium particles and precious metal nanoparticles are sintered on the surface of the container to form a nano-scale precious metal film.

Figure 2:
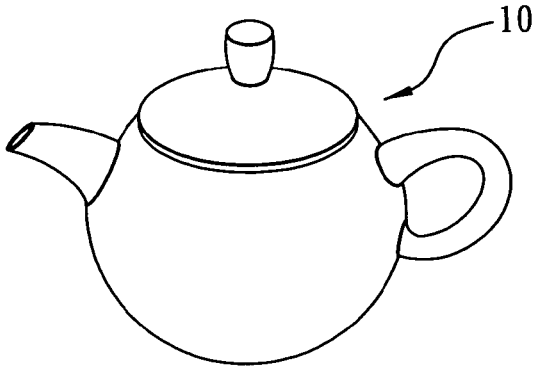
FIG. 2 is a schematic view of a ceramic teapot made by a manufacturing process of the present invention.
Figure 3:
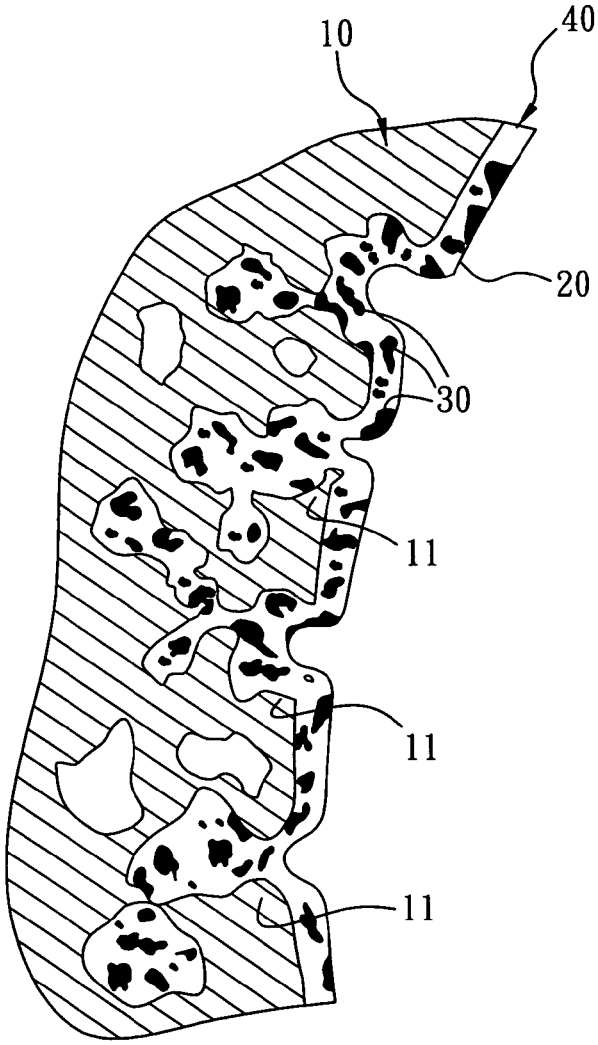
FIG. 3 is a microcosmic cross-sectional view of a partial structure of the ceramic teapot as depicted in FIG. 2.

Referring to FIG. 2 for a preferred embodiment of the present invention, the container 10 is a ceramic teapot made of a porous ceramic material or a stone teapot, and the nano-scale precious metal could be gold (Au), silver (Ag), platinum (Pt), ruthenium (Ru) and palladium (Pd), alloys of two or more of the above, etc. In this embodiment, silver is formed into nano-scale particles with a size of approximately 1 nm to 100 nm, i.e., a size falling between a molecule and a submicron. An intermedium material is selected, which is silica (silicon dioxide) in this embodiment, and also formed into particles, preferably also in nano-scale. The silver nanoparticles and the silica particles are added into a solution, and evenly mixed. The temperature of the solution is maintained at room temperature (approximately between 20° C. and 30° C.). Then, the ceramic pot or stone teapot 10 is placed into an oven and heated at a temperature of 60° C.~110° C. The temperature difference between the solution and the teapot 10 should be large enough, preferably larger than 30° C., so that the mixed silver nanoparticles and silica particles permeate into the pores densely distributed on the surface of the teapot 10. After silver nanoparticles and silica particles permeate sufficiently into the pores on the surface of the ceramic pot or stone teapot 10, the ceramic pot or stone teapot 10 is removed from the solution and placed into an oven and heated at a high temperature, preferably higher than 450° C., and may be in a rang from 450° C. to 950° C., so as to evaporate the water content in the solution. As shown in FIG. 3, the silica particles having permeated into the pores 11 of the ceramic pot or stone pot 10 become melted silica film 20, and tightly combine with the silver nanoparticles 30. Thus, the silica film 20 and the silver nanoparticles 30 are sintered onto the surface and in the pores 11 of the ceramic pot or store teapot 10, to form a nano-scale silver film 40 on the surface of the ceramic pot or stone pot 10.

As shown in the preferred embodiment as shown in FIG. 3, silver nanoparticles 30 and silica particles are sintered onto the surface of the ceramic pot or stone teapot 10 and in the densely distributed pores 11, such that the silver nanoparticles 30 and the porous material of the ceramic pot or stone pot 10 are strongly combined together. The resultant nano-scale silver film 40 is enduring and robust. The released silver ions not only have significant bacteriostasis and disinfection effects, but also effectively suppress the growth of moulds, so as to achieve the effects of preventing tea from being deteriorated or getting rotten and also providing an effect of removing peculiar smells and catalyzing the aroma of the tea. Therefore, the ceramic pot or stone pot 10 can achieve enduring anti-bacteria, antiseptic and catalytic effects.

It is readily conceivable to one skilled in this art that the present invention may be applied to make products other than a teapot. The container could be, but is not limited to, a coffee pot, a bowl, a large pot, a pan, a kettle, an so on, made of a porous material for containing drinks, food, soups or liquid medicine. In addition to silica, the material of the intermedium particles can be substituted by other materials such as aluminum trioxide, as long as such intermedium material has a material property that is similar to the material property of the material making the container, so that particles made of such intermedium material may combine with the surface of the container after sufficiently heated. All such variations, and other modifications, substitutions and/or equivalents, are intended to be covered in the scope of the present invention.

What is claimed is:

1. A method of making a container comprising:

adding precious metal nanoparticles and intermedium particles to a solution;

providing a container body having a plurality of pores on a surface thereof;

creating a temperature difference between said solution and said container body so that said precious metal nanoparticles and said intermedium particles permeat into said pores distributed on the surface of said container body; and providing a temperature sufficient for sintering said intermedium particles and said precious metal nanoparticles with said pores.

2. The method of claim 1, further comprising the steps of:

maintaining said solution at a first temperature;

heating said container body to a second temperature higher than said first temperature; and immersing said container body into said solution.

3. The method of claim 1, wherein said sintering step comprises the steps of:

heating said container at a third temperature such that the water content in said solution is substantially evaporated, and said intermedium particles are melted and combined with said precious metal nanoparticles; and forming a nano-scale precious metal film.

4. The method of claim 1, wherein said temperature difference is larger than 30° C.

5. The method of claim 4, wherein said temperature difference is between 40° C. and 80° C.

6. The method of claim 2, wherein said first temperature is between 20° C. and 30° C.

7. The method of claim 6, wherein said second temperature is between 60° C. and 110° C.

8. The method of claim 1, wherein said nano precious metal is gold, silver, platinum, ruthenium, or palladium.

9. The method of claim 1, wherein said intermedium particles are made of a material which has a material property that is similar to that of the material of the container body.

10. The method of claim 9, wherein said intermedium particles are intermedium nanoparticles.

11. The method of claim 1, wherein said intermedium particles are silicon dioxide nanoparticles or aluminum trioxide nanoparticles.

12. The method of claim 3, wherein said third temperature is above 450° C.

13. The method of claim 12, wherein said third temperature is between 450° C. and 950° C.

* * * * *